US005499400A

United States Patent [19]

Masuda et al.

[11] Patent Number: 5,499,400

[45] Date of Patent: Mar. 19, 1996

[54] WORK GLOVES AND MANUFACTURE THEREOF

[75] Inventors: Haruyuki Masuda; Yasuo Takata, both of Naruto, Japan

[73] Assignee: Nankai Technart Corporation, Naruto, Japan

[21] Appl. No.: 165,368

[22] Filed: Dec. 10, 1993

[51] Int. Cl.[6] ..... A41D 13/10; A41D 19/00; A41D 19/04

[52] U.S. Cl. ..... 2/161.6; 424/402; 66/202; 2/167

[58] Field of Search ..... 2/161.6, 161.7, 2/161.8, 164, 167, 168; 66/174, 202; 424/402, 404

[56] References Cited

U.S. PATENT DOCUMENTS

| | | | |
|---|---|---|---|
| 4,035,146 | 7/1977 | Brenner et al. | 424/404 X |
| 4,156,753 | 5/1979 | Tanaka | 2/161.6 X |
| 4,371,988 | 2/1983 | Berend | 2/161.6 X |
| 4,536,890 | 8/1985 | Barnett et al. | 2/161.6 X |
| 4,721,511 | 1/1988 | Kuptis | 424/404 X |
| 4,727,868 | 3/1988 | Szycher et al. | 424/402 X |
| 5,003,638 | 4/1991 | Miyake et al. | 2/167 |
| 5,087,499 | 2/1992 | Sullivan | 2/167 X |
| 5,089,205 | 2/1992 | Huang et al. | 424/404 X |
| 5,181,276 | 1/1993 | Kersten et al. | 2/161.7 |
| 5,224,363 | 7/1993 | Sutton | 2/167 X |

*Primary Examiner*—John J. Calvert
*Attorney, Agent, or Firm*—Curtis, Morris & Safford

[57] ABSTRACT

Work gloves having a flexibility that is improved by the restriction of the degree of infiltration of the coating so as to produce a thin coating when the outer surface of a knit glove is covered with a coating made of vinyl chloride resin, rubber or the like, and subjected to an antimicrobial and/or deodorizing treatment by a facilitated manufacturing technique. Yarn processed by an antimicrobial and/or deodorizing agent and a water and/or oil repellent agent and non-processed yarn are combined together. A glove is knitted such that the processed yarn appears on the inner surface side of the glove, and the outer surface of the glove is coated with a coating material such as a vinyl chloride resin paste or natural rubber while the infiltration of the coating material into the inner surface is suppressed by the water and oil repellency. Thereby, a flexible coating is obtained, and the inside of the glove that comes into contact with a hand is subjected to an antimicrobial and/or deodorizing treatment.

22 Claims, 3 Drawing Sheets

WORK GLOVES AND MANUFACTURE THEREOF

BACKGROUND OF THE INVENTION

1. Field of the Invention

This invention relates to work gloves and a manufacturing method thereof, in which the outer surface of seamless knitted gloves which are subjected to an antimicrobial and/or deodorizing treatment is provided with a flexible coating such as a vinyl chloride resin coating, a natural rubber coating, or a synthetic rubber coating.

2. Description of the Prior Art

There are gloves manufactured by sewing knit fabrics together and work gloves covered with a resin film or a rubber film by applying a vinyl chloride resin paste or a natural rubber latex on the outer surface of the gloves with allowance for an improvement in durability. These gloves have been widely used heretofore.

When a coating material such as a vinyl chloride resin paste and a rubber latex is applied to the surface of either the sewn gloves of fabrics made by knitting yarn as mentioned above or the knitted gloves made by directly knitting yarn into the shape of gloves, the coating material becomes easily infiltrated into the fabric or stitches if a viscosity of this coating material is set low. This causes the coating material to penetrate through the knitted gloves into the inner surface thereof, thereby impairing a feeling of the gloves. To prevent this, it is necessary to suppress the infiltration of the coating material by setting the viscosity of the coating material to be used relatively high.

However, when the viscosity of the coating material is set high, a resultant coating film becomes thick, thereby leading to a lack of flexibility which is essential to work gloves. This affects workability when the work gloves are worn by a user.

In respect of the foregoing problem, it is effective to produce the coating film as thin as possible in order to improve the flexibility of the work gloves. However, when the viscosity of the coating material is set low for this reason, the coating material infiltrates deep into the fabric or stitches of the foregoing gloves. Therefore, it is necessary to strictly control the viscosity and applying conditions of the coating material, which prevents an improvement in productivity.

As a means for resolving the above problem, there is adopted a technique which improves the flexibility and feeling of gloves by subjecting sewn or knitted gloves to water or oil repellent treatments so as to suppress the infiltration of a coating material and, hence, the penetration-through of the same. The water or oil repellent treatments are effected by impregnating treatment agents In the gloves after the gloves have been made by sewing or knitting.

Gloves that undergo water or oil repellent treatments in a post process as mentioned above cause manufacturing processes and manufacture managements to be complicated and troublesome. This, in turn, leads to a drop in production efficiency and a rise in cost.

The water or oil repellent treatments may encounter a problem that the excessive water or oil repellency afforded to a glove material hinders a coating material, such as a vinyl chloride resin paste and a rubber latex, from attaching itself evenly to the surface of the glove material, and the resultant uneven application of the coating material leads to a coating with a lack of a predetermined thickness or the formation of pin holes.

By the way, work gloves with the surface thereof coated with a resin or rubber film, as mentioned above, are poor in air permeability because of the presence of a plastic coating or the like on the surface of the glove. This causes the inner surface side of the glove to become stuffy when the glove is used, and also microbes (Staphylococcus epidermidis, Staphylococcus aureus, coliform, or the like) to proliferate because of sweat and dirt on the skin attached to the glove. This causes the glove to give off a bad smell, and occasionally causes skin to be chapped.

SUMMARY OF THE INVENTION

In view of the foregoing descriptions and observations, the object of this invention is to provide sanitary work gloves and a facilitated manufacturing method thereof, in which gloves are covered with a flexible coating without the penetration-through of the coating when a coating material such as a vinyl chloride resin paste and a rubber latex is applied to the outer surface of knitted gloves, and also the gloves are subjected to an antimicrobial and/or deodorizing treatment.

To achieve the above object, the present invention provides work gloves, comprising:

knitted gloves which are knitted by the combination of non-processed or untreated yarn and yarn processed or treated by an antimicrobial and/or deodorizing agent and a water and/or oil repellent agent such that the processed yarn appears on the inner surface side of the gloves; and a flexible coating such as a vinyl chloride resin coating, a natural rubber coating or a synthetic rubber coating formed on the outer surface of the knitted gloves.

In addition, the present invention provides a method for manufacturing work gloves comprising the steps of:

combining non-processed yarn with yarn processed by an antimicrobial and/or deodorizing agent and a water and/or oil repellent agent;

knitting gloves such that the processed yarn appears on the inner surface of the gloves;

applying a coating material such as a vinyl chloride resin paste, a natural rubber latex or a synthetic rubber latex to the outer surface of the knitted gloves under no or low hydraulic pressures by means of a dropping coating, spray coating, inclined dip coating or the like;

heating the coating film so that the coating can be melted, and gel completely, or can be vulcanized; and cooling the gloves, so that a flexible coating such as a vinyl chloride resin coating, a natural rubber coating or a synthetic rubber coating is formed on the surface of the knitted gloves.

Fibrous yarn produced from natural or synthetic fibrous yarn or breached natural or synthetic fibrous yarn is used as the previously mentioned processed yarn and non-processed yarn. In this preferred mode, it is desirable that the yarn should be subjected to both the water repellent treatment and the oil repellent treatment. However, it is possible to subject the yarn only to one of them. Moreover, in this preferred mode, in view of sanitation, it is desirable that the yarn should be subjected to both the antimicrobial treatment and the deodorizing treatment. However, it is possible to subject the yarn only to one of them. The processed yarn is subjected to a water and/or oil repellent treatment by impregnating a water and/or oil repellent agent into the fibrous fibers, and concurrently to an antimicrobial and/or deodorizing treatment by impregnating an antimicrobial and/or deodorizing agent into the fibrous fibers. A fluorine resin having an oil repellency is used, as the water and/or oil repellent agent, with a plasticizer of a vinyl chloride resin paste. Meanwhile, a fluorine resin having a water repellency is used, as the water and/or oil repellent agent, with a natural rubber latex or a synthetic rubber latex. In addition, organosilicone quaternary ammonium salts or the like are used with the antimicrobial and/or deodorizing agent.

In the work gloves, according to the present invention, the gloves are knitted such that the yarn processed by the water and/or oil repellent agent appears on the inner surface side of the glove, and the outer surface of the gloves are covered with a flexible coating. The processed yarn suppresses the infiltration of the coating into stitches, and hence the coating is adhesively impregnated into the surface of the glove without penetrating through the glove. Hence, the resulting coating is thin and very flexible, thereby leading to an improved workability when the work gloves are worn by a user. In addition, since the yarn processed by an antimicrobial and/or deodorizing treatment appears only on the inner surface side of the knitted glove that comes into contact with a hand, the proliferation of bacteria is suppressed by the effective antimicrobial and/or deodorizing effect, thereby preventing the emission of a bad smell and rendering the gloves sanitary.

In the method for manufacturing work gloves, according to the present invention, the infiltration of the coating material into stitches is suppressed by means of the processed yarn by covering, with a coating material, the outer surface of the knitted glove which is knitted such that the yarn processed by the water and/or oil repellent agent appears on the inner surface side of the glove. The coating material infiltrates into the non-processed yarn on the surface of the glove without striking through the glove, and is retained by the knitted glove. Thereafter, the coating film and the knitted glove are completely adhered to each other by a heat treatment. In addition, the suppression of the infiltration of the coating material makes it possible to set the viscosity of the coating material low. As a result of this, work gloves having plenty of flexibility are obtained by the formation of a thin coating film. Also, this makes a wider usable range of the viscosity of a coating material available. Thus, a strict management of fluidity becomes unnecessary, and hence a manufacturing management technique is simplified, thereby leading to a rise in production efficiency which, in turn, involves a reduction in the manufacturing cost.

DETAILED DESCRIPTION OF THE INVENTION

Figure 1:
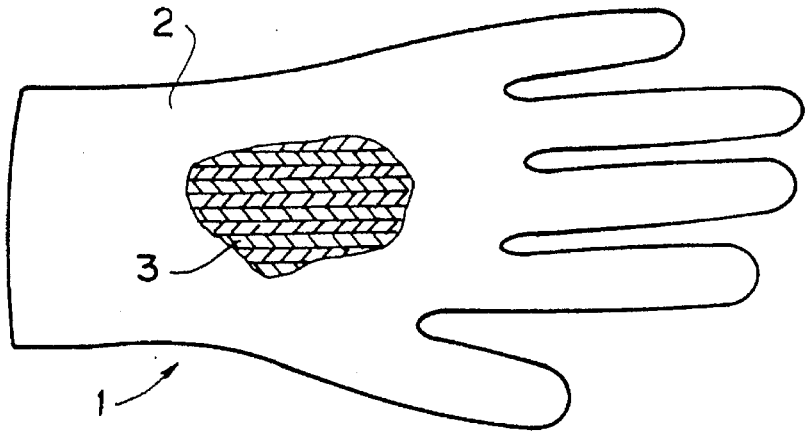
FIG. 1 is a partially cut-away front elevation view showing a work glove according to one embodiment of this invention.
Figure 2:
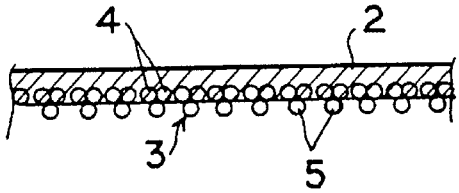
FIG. 2 is an enlarged cross-sectional view showing a cross-sectional structure of the work glove.

With reference to the accompanying drawings, preferred embodiments of this invention will be described hereinbelow. FIG. 1 is a partially cut-away front elevation view showing a work glove according to one embodiment of this invention; and FIG. 2 is a cross-sectional view of that glove.

A work glove 1 is composed of an outer flexible coating 2 and an inner knitted glove 3. The flexible coating 2 is produced from a vinyl chloride resin coating, a natural rubber coating, a synthetic rubber coating or the like. The inner side of this flexible coating 2 is infiltrated into stitches and fibers of the outer side of the knitted glove 3, and hence they are integrated with each other.

Figure 3:
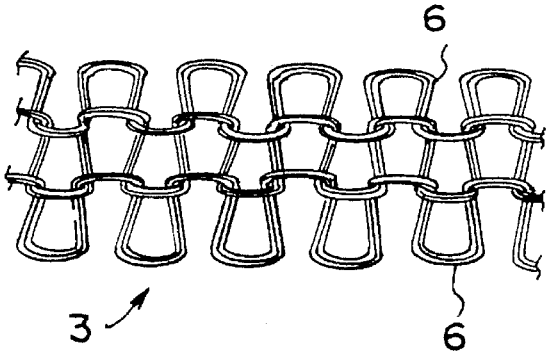
FIG. 3 is an enlarged view showing an example of knitting of a knitted glove.
Figure 4:
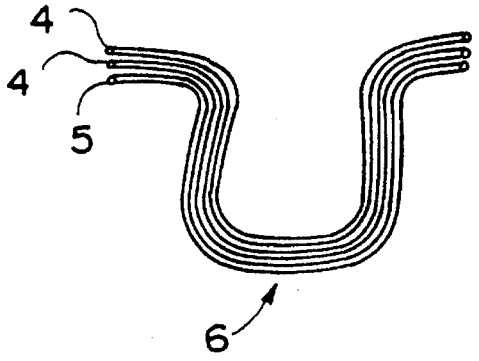
FIG. 4 is an enlarged view showing individual strand of yarn of the knitted glove.
Figure 5:
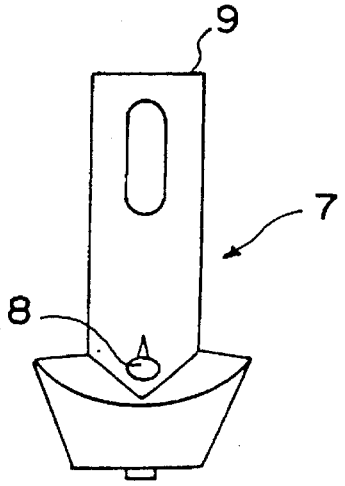
FIG. 5 is a front elevation view showing a yarn-aligning instrument used when a glove is knitted in a manufacturing method according to this invention.
Figure 6:
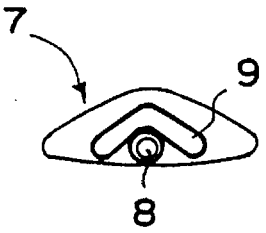
FIG. 6 is a plan view showing the yarn-paralleling instrument shown in FIG. 5.

As shown in a partially enlarged manner in FIG. 3, the glove 3 is knitted into the shape of a glove with combined yarn 6 by means of a known glove knitting machine or the like. As shown in a further enlarged manner in FIG. 4, the combined yarn 6 is composed of a strand of processed yarn 5 and two strands of non-processed yarn 4 and 4, and the glove is knitted such that the processed yarn appears on the inner surface side of the glove.

The processed yarn 5 is made of natural or synthetic fibers which are employed as material, and is subjected to a water and/or oil repellent treatment and an antimicrobial and/or deodorizing treatment. In tills embodiment, it is desirable that the yarn should be subjected to both the water repellent treatment and the oil repellent treatment. However, it is possible to subject the yarn only to one of them. Moreover, in this embodiment, in view of sanitation, it is desirable that the yarn should be subjected to both the antimicrobial treatment and the deodorizing treatment. However, it is possible to subject the yarn only to one of them. On the other hand, the non-processed yarn 4 is ordinary yarn made of natural or synthetic fibers or bleached natural or synthetic fibers, and is subjected to neither the water and/or oil repellent treatment nor the antimicrobial and/or deodorizing treatment.

The treatment of the processed yarn 5 is specifically illustrated. A cheese on which a single yarn with a number of 30 is wound is rewound into a cone by setting a winding density to 0.3. Next, the rewound cone is set in a cheese dyeing machine, and a processing liquid is introduced into this dyeing machine. This liquid is then circulated by a pump. This processing liquid Is a solution composed of fluorine resin emulsion having a water and oil repellency, organosilicone quaternary ammonium salts serving as an antimicrobial and/or deodorizing agent and a leveling agent. The input of the processing liquid is set to, For example, fifteen times as large as the amount of yarn, and the temperature of the processing liquid is increased to 40° C. The cyclic pressure of the processing liquid is adjusted to be about 7 kg/cm$^2$ such that the processing liquid circulates from the inside to the outside of the cone. Reverse operations for inverting the flow of the processing liquid from the outside to the inside are carried out every five minutes. These operations are repeated three times to cause the processing liquid to impregnate into the yarn. Thereafter, the cone is taken out of the dyeing machine, and is set in a blow pressure dryer. The cone is then subjected to drying for thirty minutes under a vapor pressure of 4.0–4.5 kg/cm$^2$ at a temperature of 110° C. After the drying, the yarn is rewound around a wooden bobbin, whereby the processed yarn 5 is obtained.

When the glove 3 is knitted by a knitting machine, a yarn aligning instrument 7 is used, whereby, one strand 5 of the processed yarn made of the single yarn with a number of 30 is passed through an inside thread guide passage 8 of the yarn aligning instrument 7, and two strands 4, 4 of the non-processed yarn made of the single yarn with a number of 30 are passed through an outside thread guide or passage 9. As a result, the strand 5 of the processed yarn and the strands 4, 4 of the non-processed yarn are fed in combination, in the form of combined yarn 6 while the strand 5 of the processed yarn is kept positioned on the inner side of this combined yarn 6 due to the specific arrangement of the inside thread passage 8 and the outside thread passage 9 in the yarn aligning instrument and the glove 3 is knitted by of the knitting machine using this combined yarn 6. In the glove 3 knitted by the use of the yarn aligning instrument 7, the processed yarn 5 appears only on the inner surface or the outer surface of the knitted glove according to the arrangement or orientation of the instrument 7, and the opposite surface of the glove is made of the non-processed yarn. Now, this knitted glove 3 is used on condition that the processed yarn 5 appears on the inner surface of the glove. When the glove is knitted in such a manner that the processed yarn 5 appears on the outer surface of the glove, the glove is used with its inside surface facing out.

Subsequently, the knitted glove 3 is arranged on a hand-shaped metal mold (aluminum mold), and the flexible coating 2 is applied to the outer surface of the glove. This flexible coating 2 employs a different manufacturing process depending on whether the coating is made of vinyl chloride resin or other synthetic resin or made of natural or synthetic rubber. The manufacturing processes are described independently of each other.

The application of the flexible coating 2 made of vinyl chloride resin is effected by the steps of: preparing a vinyl chloride resin paste, the viscosity of which is adjusted to be about 3000 cp; coating the outer surface of necessary parts such as the palm, back, fingers of the glove 3 with this vinyl chloride resin paste without the application of a hydraulic pressure by a dropping application; and removing excessively applied resin paste by natural dropping.

In the application of the coating material with the use of a plasticizer dispersed system vinyl chloride resin paste, the non-processed yarn 4 appears on the outer surface side of the knitted glove 3, and the yarn 5 processed by a water and/or oil repellent treatment appears on the inner surface side of the glove. Thereby, the vinyl chloride resin paste infiltrating into the non-processed yarn 4 on the outer surface side of the glove. The oil-repellency of the processed yarn 5 inside the glove prevents the paste from infiltrating into and penetrating through the glove. The inner surface of the glove 3 is left with its feeling of a fibrous yarn kept intact.

Next, after the coating, the knitted gloves are introduced into a hot air circulating furnace at an atmospheric temperature of 180° C. The gloves are heated for fifteen minutes, so that the applied vinyl chloride resin paste is melted, and gels completely. Then, the gloves are taken out of the furnace, and the gloves are removed from the hand-shaped mold after they have been cooled. Thus, sanitary work gloves 1 having plenty of flexibility and a superior feeling are manufactured, in which the yarn 5 processed by an antimicrobial and/or deodorizing treatment appears on the inner surface side of the glove, and the outer surface of the knitted glove 3 is covered with the flexible coating 2 made of vinyl chloride resin.

The application of the flexible coating 2 made of natural rubber comprises the steps of: preparing a natural rubber latex, the viscosity of which is adjusted to be about 400 cp; coating the outer surface of necessary parts such as the palm, back, and fingers of the knitted glove 3 with this natural rubber latex without the application of a hydraulic pressure by a dropping application; and drying the gloves in a hot air circulating furnace at an atmospheric temperature of 90° C. for ten minutes. Subsequently, the gloves are subjected to a second coating by an inclined dipping application by immersing at an angle of 35° in a natural rubber latex whose viscosity is adjusted to be 50 cp such that only a small hydraulic pressure is exerted on the coating.

Even in the application of a coating material made of a water-dispersed system natural rubber latex, the non-processed yarn 4 appears on the outer surface side of the knitted gloves 3, and the yarn 5 processed by a water and/or oil repellent treatment appears on the inner surface side. For this reason, the applied natural rubber latex infiltrates into the non-processed yarn 4 on the outer surface side of the glove, but the further infiltration of the rubber latex is hindered by the water repellency of the processed yarn 5 on the inner surface side of the glove, thereby preventing the penetration-through of the coating. Hence, the inner surface side of the knitted glove 3 remains with its feeling intact.

This glove is then introduced into a hot air circulating furnace at an atmospheric temperature of 100° C., and is dried for ten minutes. Further, the glove is introduced into another hot air circulating furnace at a temperature of 120° C., and is heated for fifteen minutes, thereby effecting a first vulcanization. Then, the glove is cooled, and removed from the handshaped mold. Thereafter, the glove is heated in the hot air circulating furnace at an atmospheric temperature of 120° C. for seven minutes so that the heating can serve as a second vulcanization and drying. The glove is taken out of the mold and cooled. Thereby, sanitary work gloves 1 having plenty of flexibility and a superior feeling are manufactured, in which the yarn processed by an antimicrobial and/or deodorizing treatment appears on the inner surface side of the knitted glove 3, and the outer surface side of the glove is covered with the flexible coating 2 made of natural rubber.

On the other hand, when the synthetic rubber coating made of the synthetic rubber latex is formed, fundamentally its application should be carried out in the same manner as in the case of the natural rubber as mentioned above. Processing conditions such as the viscosity, drying temperature and vulcanizing temperature of a coating material depend on the material of the synthetic rubber latex.

An organic solvent dispersed liquid such as ethylene chloride trifluoride resin, ethylene tetrafluoride resin, fluorinated polyacrylic resin, perfluoroalkoxyethylene or the like or an aqueous suspension can be used as the water and/or oil repellent agent. Particularly, they are usable as either a water repellent agent or a coagulating agent with respect to a processed yarn used with a natural rubber latex. Organosilicone quaternary ammonium salts which act as the antimicrobial and/or deodorizing agent are medicine which are not subjected to elution, and the composition of the salts reacts with cellulose of fibers, so that the agent is fixed. The antimicrobial and/or deodorizing agent is not eluted by sweat, and shows an antimicrobial action. A sufficient effectiveness is obtained by the use of one strand of processed yarn on the side of the glove that comes into contact with hands, but another known antimicrobial and/or deodorizing agent may be used.

In the above embodiment, the glove is knitted by using the combination of one strand of processed yarn and two strands of non-processed yarn. However, if necessary, the combination of yarn can be changed, for example, to the combination of two strands of processed yarn and one strand of non-processed yarn or the combination of two strands of processed yarn and two strands of non-processed yarn.

The change of the combination of yarn changes the degree of infiltration of a coating, and hence the flexibility of the glove can be set appropriately. A similar result can be yielded by changing the concentration of a processing liquid, that is a water and/or oil repellent agent.

According to work gloves of this invention, yarn processed by the antimicrobial and/or deodorizing agent and the water and/or oil repellent agent and non-processed yarn are used in combination. Also, the processed yarn appears on the inner surface of the glove, and the outer surface of the glove is covered with a flexible coating made of a vinyl chloride resin coating, a natural rubber coating, or a synthetic rubber coating. Resultant gloves are provided with a thin coating, and have plenty of flexibility and a superior workability when the gloves are worn. Moreover, the gloves are sanitary, because they are subjected to an effective antimicrobial and/or deodorizing treatment.

According to the method for fabricating the work gloves of this invention, yarn processed by the antimicrobial and/or deodorizing agent and the water and/or oil repellent agent and non-processed yarn are combined together, and a glove is knitted such that the processed yarn appears on the inner surface of the glove. Also, the outer surface of the glove is covered with a coating material under no hydraulic pressure or a low hydraulic pressure. This glove is then subjected to a heat treatment, so that a flexible coating is adhesively formed. This makes it possible to set the viscosity of the coating material low, and render a wider usable range of viscosity of the coating material available. Thus, the present invention is superior in practical value, because this makes it possible to simplify a manufacture management technique, and to raise production efficiency which involves a reduction in manufacturing cost.

Figure 7:
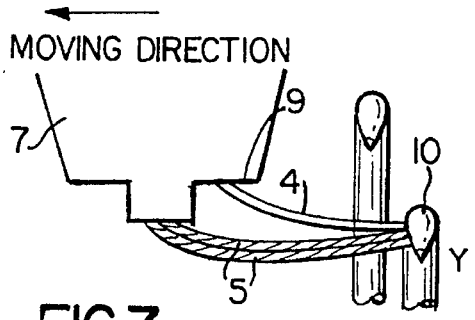
FIG. 7 is a front view illustrating how two strands of treated yarn and one strand of untreated yarn can be combined together by a yarn aligning instrument used in a method according to this invention.
Figure 8:
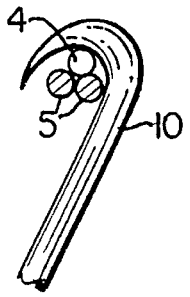
FIG. 8 is a side view taken at point Y of FIG. 7.
Figure 9:
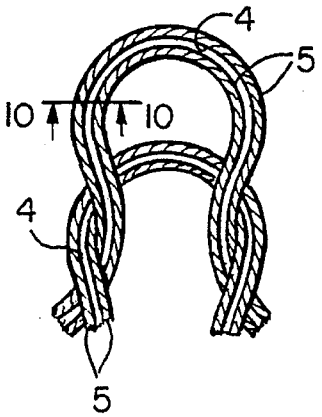
FIG. 9 is a front view illustrating two strands of treated yarn and one strand of untreated yarn combined together according to the method of FIG. 7.
Figure 10:
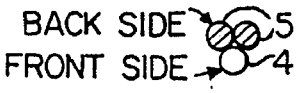
FIG. 10 is a sectional view taken along line A–A of FIG. 9.
Figure 11:
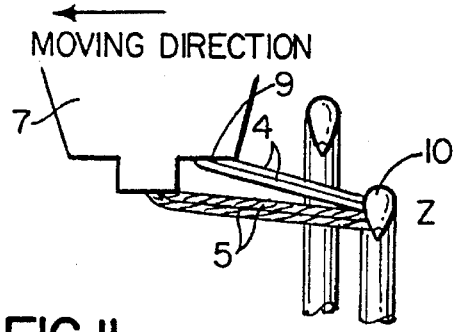
FIG. 11 is a front view illustrating how two strands of treated yarn and two strands of untreated yarn are combined together by a yarn aligning instrument used in a method according to this invention.
Figure 12:
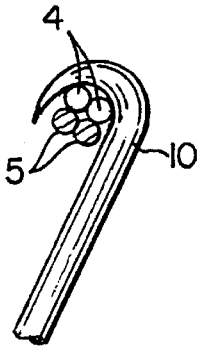
FIG. 12 is a side view taken at point Z of FIG. 11.
Figure 13:
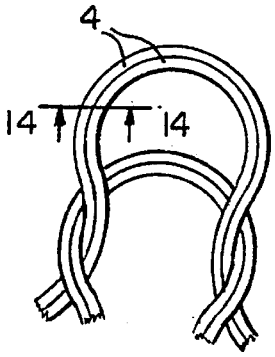
FIG. 13 is a front view illustrating two strands of treated yarn and two strands of untreated yarn combined together according to the method of FIG. 11.
Figure 14:
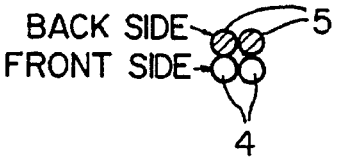
FIG. 14 is a sectional view taken along line B–B of FIG. 13.

FIGS. 7 through 14 illustrate various combinations of strands of treated yarn and untreated yarn to form a combined yarn. More specifically, FIGS. 7 through 10 illustrate how two strands of treated yarn 5,5 and one strand of untreated yarn 4 are combined together in a method according to the present invention. In FIG. 7, the combined yarn is formed by feeding two strands of treated yarn 5,5 and one strand of untreated yarn 4 in a specific arrangement by utilizing the yarn aligning instrument 7 and by joining the strands together through a needle 10 of the knitting machine grasping the errands from thereabove and pushing them downwardly (see FIG. 8). FIGS. 9 and 10 illustrated the two strands of treated yarn 5,5 and one strand of untreated yarn 4 combined together by the method of FIG. 7. FIGS. 11 through 14 illustrate how two strands of treated yarn 5,5 and two strands of untreated yarn 4,4 can be combined together into a combined yarn by a method of the present invention. As shown in FIG. 11, the combined yarn herein is formed by feeding the two strands of treated yarn 5,5 and two strands of untreated yarn 4,4 in a specific arrangement by utilizing the yarn aligning instrument 7 and by joining them together through the needle 10 of the knitting machine grasping the strands from thereabove and pushing them downwardly (see FIG. 12). FIGS. 13 and 14 illustrate the two strands of treated yarn 5,5 and two strands of untreated yarn 4,4 combined together by the method of FIG. 11.

It will be understood that the above description of the present invention is susceptible to various modifications, changes, and adaptations and that the same are intended to be comprehended within the meaning and range of equivalents of the appended claims.

What is claimed is:

1. Work gloves comprising:

knitted gloves having an inner surface and an outer surface, the gloves are knitted using a combination of untreated yarn and yarn treated with a first agent selected from the group consisting of an antimicrobial agent and a deodorizing agent and a repellent agent selected from the group consisting of a water repellent agent and an oil repellent agent, said treated yarn appearing on the inner surface side of said knitted gloves; and a flexible coating formed on the outer surface of said knitted gloves.

2. Work gloves as defined in claim 1, wherein said treated and untreated yarns are selected from the group consisting of natural fibrous yarn, synthetic fibrous yarn, and bleached natural fibrous yarn.

3. Work gloves as defined in claim 2, wherein said processed yarn is impregnated with said repellent agent, and is impregnated with said first agent.

4. Work gloves as defined in claim 3, wherein a fluorine resin having a water repellency is used as said repellent agent with a rubber latex selected from the group consisting of a natural rubber latex and a synthetic rubber latex.

5. Work gloves as defined in claim 3, wherein organosilicone quaternary ammonium salts are used as said first agent.

6. Work gloves as defined in claim 3, wherein a fluorine resin having an oil repellency is said repellent agent and is in combination with a plasticizer of a vinyl chloride resin paste.

7. Work gloves as defined in claim 1, wherein said flexible coating is selected from the group consisting of a vinyl chloride resin coating, a natural rubber coating and a synthetic rubber coating.

8. A method for manufacturing work gloves having an inner surface and an outer surface comprising the steps of:

combining untreated yarn and yarn treated with a first agent selected from the group consisting of an antimicrobial agent and a deodorizing agent and a repellent agent selected from the group consisting of a water repellent agent and an oil repellent agent to form combined yarn in which said processed yarn is positioned at one side of said combined yarn;

knitting gloves using said combined yarn such that said treated yarn appears on the inner surface of said gloves;

applying a coating material to the outer surface of the knitted gloves;

heating the coating material so that said coating material is melted to gel completely; and cooling the knitted gloves so that a flexible coating is formed on the outer surface of said knitted gloves.

9. A method for manufacturing work gloves as defined in claim 8, wherein said treated and untreated yarns are selected from the group consisting of natural fibrous yarn, synthetic fibrous yarn and bleached natural fibrous yarn.

10. A method for manufacturing work gloves as defined in claim 9, further comprising impregnating said treated yarn with said repellent agent, and with said first agent.

11. A method for manufacturing work gloves as defined in claim 10, further comprising applying a fluorine resin having an oil repellency as said repellent agent with a plasticizer of a vinyl chloride resin paste.

12. A method for manufacturing work gloves as defined in claim 8, further comprising combining one strand of said treated yarn and two strands of said untreated yarn together.

13. A method for manufacturing work gloves as defined in claim 8, further comprising combining two strands of said treated yarn and one strand of untreated yarn together.

14. A method for manufacturing work gloves as defined in claim 8, further comprising combining two strands of said treated yarn and two strands of untreated yarn together.

15. A method for manufacturing work gloves as defined in claim 8, further comprising selecting said coating material from the group consisting of a vinyl chloride resin coating, a natural rubber coating and a synthetic rubber coating.

16. A method for manufacturing work gloves as defined in claim 8, the further step of applying said coating material to the outer surface of the knitted gloves under low hydraulic pressure.

17. A method for manufacturing work gloves as defined in claim 8, the further step of applying said coating material to the outer surface of the knitted gloves by means of drop coating.

18. A method for manufacturing work gloves as defined in claim 8, the further step of applying said coating material to the outer surface of the knitted gloves by means of spray coating.

19. A method for manufacturing work gloves as defined in claim 8, the further step of applying said coating material to the outer surface of the knitted gloves by means of inclined dip coating.

20. A method for manufacturing work gloves as defined in claim 8, the further step of applying a fluorine resin having a water repellency as said repellent agent with rubber latex selected from the group consisting of a natural rubber latex and a synthetic rubber latex.

21. A method for manufacturing work gloves as defined in claim 8, the further step of applying organosilicone quaternary ammonium salts as said first agent.

22. A method for manufacturing work gloves having an inner surface and an outer surface comprising the steps of:

combining untreated yarn and yarn treated with a first agent selected from the group consisting of an antimicrobial agent and a deodorizing agent and a repellent agent selected from the group consisting of a water repellent agent and an oil repellent agent to form combined yarn in which said treated yarn is positioned at one side of said combined yarn;

knitting gloves using said combined yarn such that said processed yarn appears on the inner surface of said gloves;

applying a coating material to the outer surface of the knitted gloves;

heating the coating material so that said coating material is vulcanized; and cooling the knitted gloves so that a flexible coating is formed on the outer surface of said knitted gloves.

* * * * *